United States Patent [19]

Spitzer et al.

[11] 4,117,958

[45] Oct. 3, 1978

[54] VAPOR TAP VALVE FOR AEROSOL CONTAINERS USED WITH FLAMMABLE PROPELLANTS

[76] Inventors: Joseph George Spitzer, 44 Coconut Row, Palm Beach, Fla. 33480; Marvin Small, 1100 Park Ave., New York, N.Y. 10021; Lloyd I. Osipow, 2 Fifth Ave., New York, N.Y. 10003; Dorothea C. Marra, 107 Fernwood Rd., Summit, N.J. 07501

[21] Appl. No.: 804,424

[22] Filed: Jun. 7, 1977

Related U.S. Application Data

[63] Continuation-in-part of Ser. No. 754,471, Dec. 27, 1976, abandoned, which is a continuation-in-part of Ser. No. 706,857, Jul. 19, 1976, abandoned.

[51] Int. Cl.[2] ..... B65D 83/14

[52] U.S. Cl. ..... 222/402.18; 137/38; 222/402.19

[58] Field of Search ..... 137/38, 43, 45; 222/402.1, 402.18, 402.19, 477, 402.24

[56] References Cited

U.S. PATENT DOCUMENTS

| | | | |
|---|---|---|---|
| 2,778,543 | 1/1957 | Urlaub | 222/402.11 X |
| 2,793,794 | 5/1957 | Samuel | 222/402.19 |
| 2,968,428 | 1/1961 | Samuel | 222/402.19 |
| 3,315,693 | 4/1967 | Braun | 137/43 |
| 3,372,843 | 3/1968 | Frangos | 222/402.18 |
| 3,472,531 | 10/1969 | Evesque | 137/43 X |
| 3,542,254 | 11/1970 | Samuelson | 222/402.19 |

*Primary Examiner*—Robert B. Reeves
*Assistant Examiner*—David A. Scherbel

[57] ABSTRACT

A vapor tap valve for aerosol containers is provided, for use with aerosol compositions containing liquefied flammable propellants, inhibiting delivery of flammable liquid propellant when the valve is opened in any orientation of the aerosol container, comprising, in combination, a delivery valve movable manually between open and closed positions and including a valve poppet, a valve stem, a valve stem passage, and a delivery port; bias means biasing the delivery valve towards a closed position; a blending space for mixing propellant and aerosol composition in fluid flow communication with the valve stem passage via the valve, the valve in the open position communicating the blending space with the valve stem passage, and in the closed position preventing such communication; a liquid tap orifice in the blending space; a gas tap orifice in the blending space; and a shut-off valve disposed in the valve poppet and responsive to orientation of the valve to move automatically between positions opening and closing off flow of propellant to the delivery port via the valve stem passage, the shut-off valve moving into an open position in an orientation of the valve between a horizontal and an upright position, and moving into a closed position in an orientation of the valve between the horizontal and an inverted position.

23 Claims, 9 Drawing Figures

FIG. 1
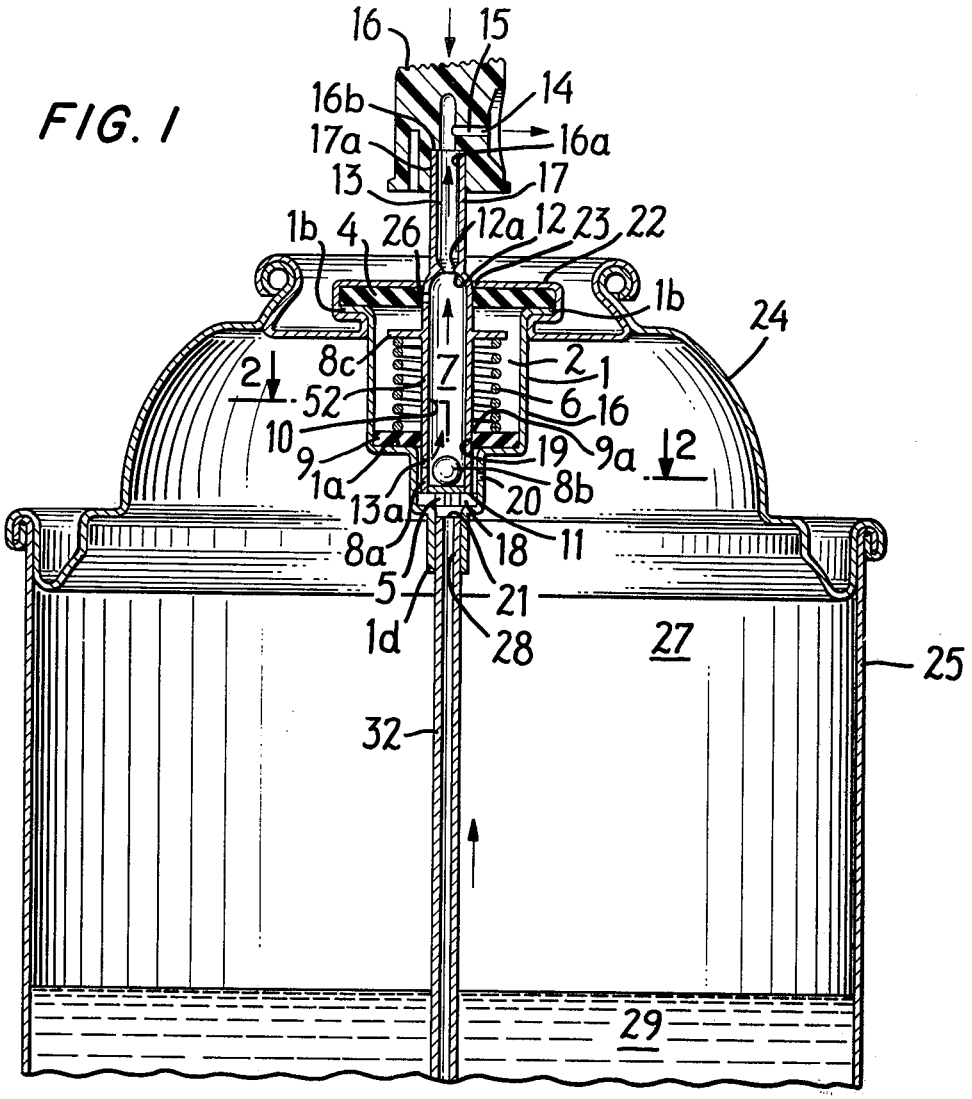
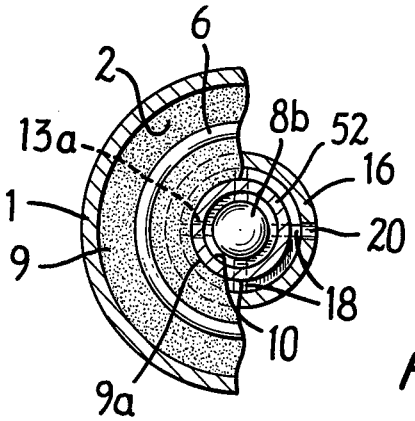
FIG. 2

FIG. 3
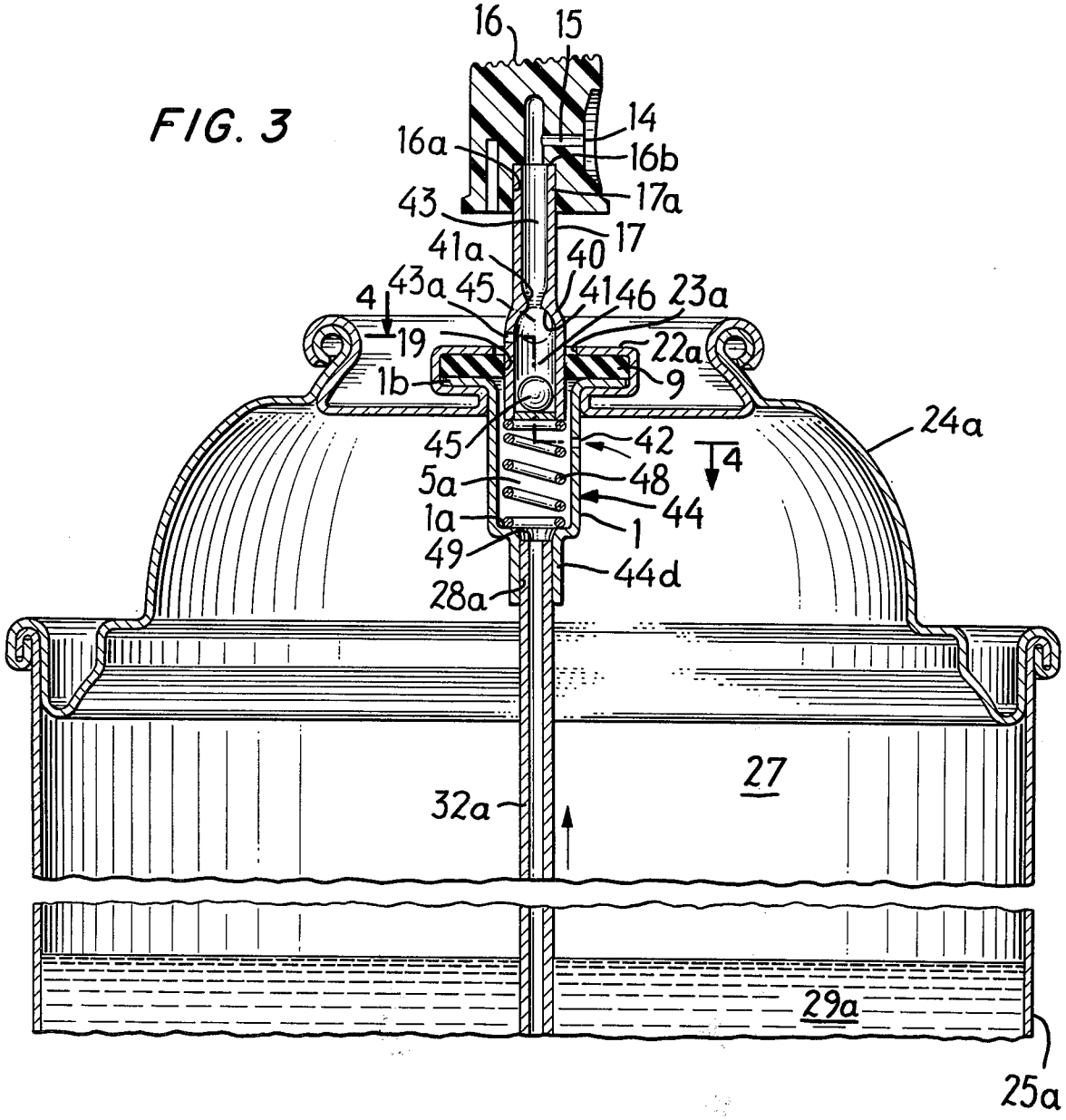
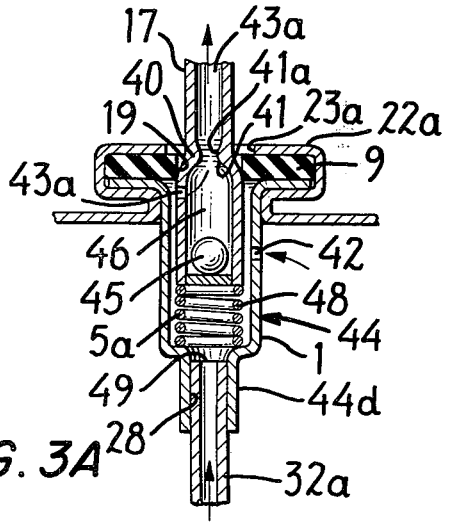
FIG. 3A
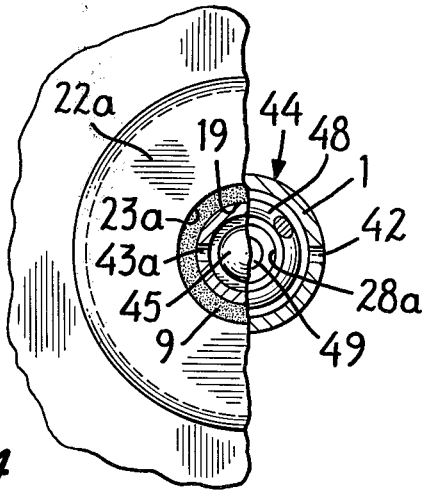
FIG. 4

FIG. 5
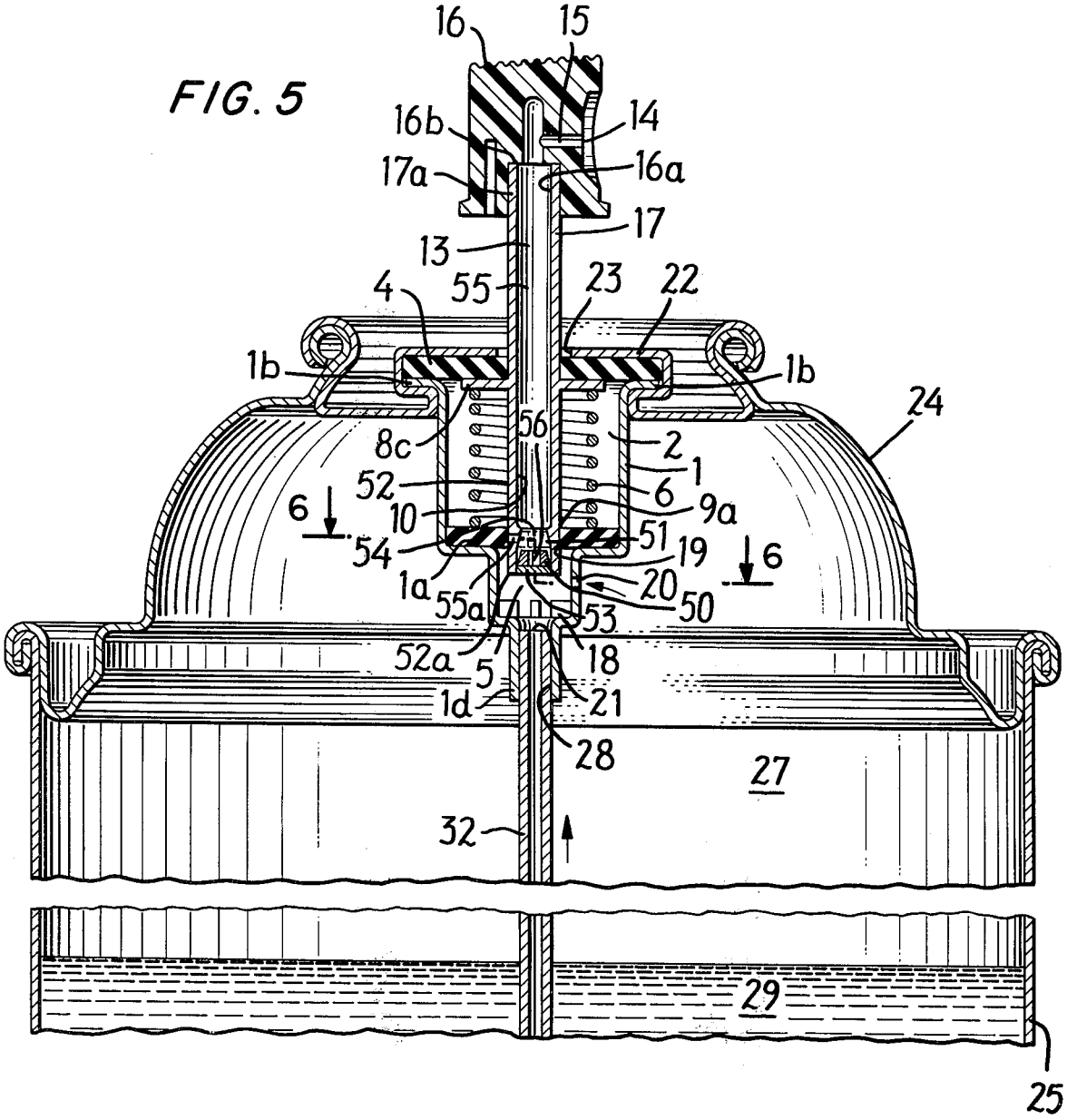
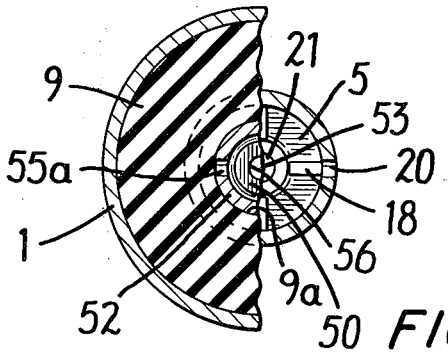
FIG. 6

VAPOR TAP VALVE FOR AEROSOL CONTAINERS USED WITH FLAMMABLE PROPELLANTS

This application is a continuation-in-part of Ser. No. 754,471, filed Dec. 27, 1976, which in turn is a continuation-in-part of Ser. No. 706,857, filed July 19, 1976, abandoned in favor of Ser. No. 751,414, filed Jan. 6, 1977.

Aerosol sprays are now widely used, particularly in the cosmetic, topical pharmaceutical and detergent fields, for delivery of an additive such as a cosmetic, pharmaceutical, or cleaning composition to a substrate such as the skin or other surface to be treated. Aerosol compositions are widely used as antiperspirants, deodorants, and hair sprays to direct the products to the skin or hair in the form of a finely-divided spray.

Much effort has been directed to the design of valves and valve delivery posts, nozzles or orifices which are capable of delivering finely-divided sprays, of which U.S. Pat. Nos. 3,083,917 and 3,083,918 patented Apr. 2, 1963, to Abplanalp et al, and No. 3,544,258 dated Dec. 1, 1970, to Presant et al, are exemplary. The latter patent describes a type of valve which is now rather common, giving a finely atomized spray, and having a vapor tap, which includes a mixing chamber provided with separate openings for the vapor phase and the liquid phase to be dispensed into the chamber, in combination with a valve actuator or button of the mechanical breakup type. Such valves provide a soft spray with a swirling motion. Another design of valve of this type is described in U.S. Pat. No. 2,767,023. Valves with vapor taps are generally used where the spray is to be applied directly to the skin, since the spray is less cold.

Marsh U.S. Pat. No. 3,148,127 patented Sept. 8, 1964 describes a pressurized self-dispensing package of ingredients for use as a hair spray and comprising isobutane or similar propellant in one phase and an aqueous phase including the hair setting ingredient. The isobutane is in a relatively high proportion to the aqueous phase, and is exhausted slightly before the water phase has been entirely dispensed. A vapor tap type of valve is used having a 0.030 inch vapor tap orifice, a 0.030 inch liquid tap orifice, and a 0.018 inch valve stem orifice, with a mechanical breakup button. There is no disclosure of the relative proportions of propellant gas to liquid phase being dispensed.

Rabussier U.S. Pat. No. 3,260,421 patented July 12, 1966 describes an aerosol container for expelling an aqueous phase and a propellant phase, fitted with a vapor tap valve, and capillary dip tube. To achieve better blending of the phases before expulsion, the capillary dip tube is provided with a plurality of perforations 0.01 to 1.2 mm in diameter over its entire length, so that the two phases are admitted together in the valve chamber from the capillary dip tube, instead of the gas being admitted only through a vapor tap orifice, and the liquid through a dip tube as is normal. The propellant is blended in the liquid phase in an indeterminate volume in proportion to the aqueous phase in the capillary dip tube.

Presant et al in U.S. Pat. No. 3,544,258, referred to above, discloses a vapor tap valve having a stem orifice 0.018 inch in diameter, a vapor tap 0.023 inch in diameter with a capillary dip tube 0.050 inch in diameter. The button orifice diameter is 0.016 inch. The composition dispensed is an aluminum antiperspirant comprising aluminum chlorhydroxide, water, alcohol and dimethyl ether. The aluminum chlorhydroxide is in solution in the water, and there is therefore only one liquid phase. The dimensions of the orifices provided for this composition are too small to avoid clogging, in dispensing an aluminum antiperspirant composition containing dispersed astringent salt particles.

The vapor tap type of valve is effective in providing fine sprays. However, it requires a high proportion of propellant, relative to the amount of active ingredients dispensed per unit time. A vapor tap requires a large amount of propellant gas, because the tap introduces a volume of propellant gas into each squirt of liquid. Such valves therefore require aerosol compositions having a rather high proportion of propellant. A high propellant proportion is dangerous and undesirable, however, when the propellant is flammable. For this reason, the art has preferred nonflammable propellants, such as the fluorocarbons. With the imminent banning of fluorocarbon propellants, however, it is now necessary for the art to turn to the flammable propellants, such as hydrocarbons and low boiling ethers, and the resulting flame hazard poses a considerable problem. The flame hazard is increased if liquefied propellant is delivered with gaseous propellant, since the liquid contains more flammable material per unit volume.

Vapor tap valves normally have a rather large valve chamber, in the walls of which are placed the vapor tap and liquid tap orifices. The valve chamber houses the bias means tending to hold the valve in a closed position, and at the same time furnishes blending space for the liquid and gaseous components of the aerosol compositions before delivery when the delivery valve is opened. The liquid tap and vapor tap orifices in the valve chamber are normally open to free entry of both liquid aerosol composition and liquefied propellant or propellant gas at all times, even when the delivery valve is closed. When the aerosol container is shaken up to provide a uniform distribution of two liquid phases or of liquid and solid phases, the valve chamber can and usually does fill with liquid propellant via at least the vapor tap orifice and possibly also the liquid tap orifice. Upon opening of the delivery valve, the volume of liquefied propellant in the valve chamber is dispensed first, within the first few seconds. This initial delivery of liquefied propellant when the propellant is flammable poses a considerable flame hazard, if the container is used in the vicinity of a flame.

A further problem peculiar to vapor tap valves arises when the container is inclined from the normally upright position to below the horizontal, or even inverted. If the container is inclined or tipped below the horizontal, or inverted, the gas propellant phase can pass through the liquid tap orifice, and the liquefied propellant and liquid aerosol composition can pass through the vapor tap orifice. Since the liquid tap orifice and the vapor tap orifice normally differ in restriction to flow, the ratio of gas to liquid is likely to be completely changed, and the proportion of flammable liquid propellant may be greatly increased, with a resulting increase in flammability of the spray that is dispensed. In this case, an extremely flammable spray can be obtained.

Aerosol containers are commonly filled so that the liquid phase occupies about 60% of the total container capacity at 21° C. With this fill in a container with minimum doming, a straight dip tube, and a vapor tap orifice about 0.6 mm in diameter, off-center and positioned downward when the container is horizontal, both vapor and liquid tap orifices will be covered by liquid when the container is positioned so that the valve is in the range of about −5° (below horizontal) to +5° (above horizontal). If the dip tube bends downward when the container is horizontal, the range in valve position in which both taps are covered by liquid may extend to about −30° (below the horizontal) to about +5° (above the horizontal). The extent or span of this range will depend on the dimensions of the container. The larger the ratio of diameter: height, the wider the span of the range.

In accordance with the invention of Ser. No. 754,471, the fire hazard poses when aerosol containers equipped with conventional vapor tap valves are tipped from the upright position to the horizontal or even inverted position, is overcome by including, in combination with the delivery valve, an overriding shut-off valve which, although normally open when the container is upright, automatically closes off flow of liquid through the delivery valve from the container to the delivery port at some limiting angle at or below the horizontal as the top of the container is brought below the horizontal, towards the fully inverted position. The shut-off valve will normally have closed fully before the container is fully inverted. The angle to the horizontal at which the valve must close is of course the angle at which liquid can flow to the delivery port and escape as liquid from the container, without benefit of a high gas ratio. This can be within the range from 0° (i.e. horizontal) to −90°, and preferably is from −5° to −45°, below the horizontal.

In this type of container, it is generally not possible to dispense the liquid contents of the container by opening the delivery valve unless the container is so oriented that a sufficient ratio of gas is expelled with the liquid phase. The container must be held in a fully upright position, or at least in a position with the valve above the horizontal. Otherwise, the liquid phase cannot flow through the open delivery valve, because the shut-off valve is closed.

The aerosol container in accordance with the invention of Ser. No. 754,471 comprises, in combination, a pressurizable container having at least one storage compartment for an aerosol composition and a liquefied propellant in which compartment propellant can assume an orientation according to orientation of the container between a horizontal and an upright position, and a horizontal and inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; and a shut-off valve responsive to orientation of the container to move automatically between positions opening and closing off flow of liquefied propellant to the delivery port, the shut-off valve moving into an open position in an orientation of the container between a horizontal and an upright position, and moving into a closed position in an orientation of the container between the horizontal and an inverted position.

A preferred embodiment of delivery valve is of the vapor tap type, comprising a valve movable manually between open and closed positions, a valve stem and a delivery port; a valve stem orifice in the valve stem, in flow connection at one end with a blending space, and at the other end with an aerosol-conveying valve stem passage leading to the delivery port; bias means for holding the delivery valve in a closed position; means for manipulating the valve against the bias means to an open position, for expulsion of aerosol composition via the valve stem orifice to the delivery port; wall means defining a blending space, and separating the blending space from liquid aerosol composition and propellant within the container; at least one liquid tap orifice through the wall means; at least one vapor tap orifice through the wall means; and a shut-off valve means movable between a closed position closing off the valve stem passage and an open position allowing aerosol composition to pass through the valve stem passage, the shut-off valve being in the open position at least when the container is fully upright, and being in the closed position at least when the container is fully inverted, and moving from the open to the closed position at an angle therebetween beyond the horizontal at which liquid propellant can flow to and through the vapor tap orifice and escape through the delivery port via the aerosol conveying valve stem passage when the delivery valve is in the open position.

The containers of Ser. No. 754,471 do not however overcome the problem of delivery even when the container is upright, or inclined but above the horizontal, of a highly flammable spray composed predominantly of liquefied flammable propellant when the container is shaken just before the delivery valve is opened, arising from the filling of the valve chamber during shaking with liquefied propellant just before delivery. This is a problem similar to that arising when the container is inverted or held at an angle to the vertical below the horizontal, even though the container may be held fully upright, because of the effect of the shaking of at least partially filling the valve chamber with liquid phase.

In accordance with the present invention, this difficulty is overcome by providing a vapor tap valve for aerosol containers comprising, in combination, a delivery valve movable manually between open and closed positions and including a valve poppet, a valve stem, a valve stem passage, a valve stem orifice leading into the valve stem passage, and a delivery port; bias means biasing the delivery valve towards a closed position; a blending space for mixing propellant and aerosol composition in fluid flow communication with the valve stem passage via the valve, the valve in the open position communicating the blending space with the valve stem passage via the valve stem orifice, and in the closed position preventing such communication; a liquid tap orifice in the blending space; a vapor tap orifice in the blending space; and a shut-off valve disposed in the valve poppet and responsive to orientation of the valve to move automatically between positions opening and closing off flow of propellant to the delivery port via the valve stem passage, the shut-off valve moving into an open position in an orientation of the valve between a horizontal and an upright position, and moving into a closed position in an orientation of the valve between the horizontal and an inverted position.

The vapor tap valve has a valve housing which may also include or is in flow connection with wall means defining the blending space. The blending space is of quite limited volume, less than 0.2 cc and preferably less than 0.1 cc. If the delivery valve when in the open position moves into the blending space, the volume is taken when the delivery valve is in the closed position. It is only as large as required for the introduction and preliminary blending of gas and liquid when the delivery valve is in the open position. Break-up of liquid droplets and further blending of gas and liquid occur in the sequential steps of passage through the valve stem orifice and any further orifices en route to the delivery port. The delivery valve is movably disposed in the valve housing for movement between open and closed positions, away from and towards a valve seat at the inner end of the valve stem passage, with which the blending space is in flow connection via the valve stem orifice when the delivery valve is open.

The volume of the blending space can be as small as 0.01 cc and is preferably from 0.01 to 0.1 cc when the delivery valve is in the open position. Inasmuch as downstream of the valve stem orifice there may be disposed additional blending space, as compared with conventional vapor tap valves, as will presently be seen, the use of a blending space of minimum volume is possible.

The liquid tap orifice communicates the blending space directly or indirectly with a capillary dip tube or a standard dip tube. A standard or capillary dip tube normally extends into the liquid composition or phase in the aerosol container, and may reach to the bottom of the container. A tail piece may be provided (but is not essential) at the valve housing as a coupling for linking the dip tube to the blending space within the valve housing. The tail piece when present has a through passage in fluid flow connection with the liquid composition or phase in the container, via the dip tube, and thence into the blending space.

The liquid tap orifice in this embodiment is an orifice or constriction in the passage, at the blending space end, at the dip tube end, or intermediate the ends. The orifice can also be in direct communication with the dip tube, in the event the tail piece is omitted. When the dip tube communicates directly with the liquid tap orifice, the liquid tap orifice can be at the end opening of the dip tube.

In the special case when a capillary dip tube is used, no liquid tap orifice as such is required. The capillary dip tube serves as the liquid tap orifice. However the size parameters for the capillary dip tube and vapor tap orifice in that event are different, because of the unique flow restriction of the capillary dip tube.

The vapor tap orifice is in fluid flow connection with the propellant or gas phase of the aerosol container, and admits gas into the blending space before the delivery valve and valve stem passage. Normally, therefore, it is in the wall defining the blending space, and above the liquid tap orifice, although this is not essential.

The vapor tap valve delivery system of an aerosol container downstream of the vapor tap delivery valve normally includes an actuator which operates the delivery valve, and is movable between open and closed positions against the biasing force of a bias means, with a valve stem and an aerosol composition-conveying valve passage therethrough, in flow connection with a delivery port.

Mixing of the gas and liquid phase occurs in the blending space before these pass through the delivery valve, and the diameters of the vapor tap and liquid tap orifices as well as the valve passage and orifices with which they are in communication are selected within the stated ranges to provide, in the blending space, a gas:liquid volume ratio within the range from about 8:1 to about 40:1, and preferably from about 15:1 to about 30:1. It will be appreciated that for a given size of these openings, the gas:liquid ratio obtained from gas and liquid fed therethrough from the supply in the container will vary with the particular propellant or propellants and the composition of the liquid phase. The viscosity of the liquid is a factor in determining the proportion that can flow through the liquid tap orifice per unit time, when the valve is open.

This type of valve is suitable for dispensing any type of aerosol spray composition, but it is especially useful where the composition contains a flammable liquefied propellant. The range of products dispensed may comprise a single liquid phase, a mixture of two or more liquid phases, or a dispersion of particulate solids in one or more liquid phases. The propellant may be the predominant component of the composition.

The product requirements may include relatively large or small droplets, high or low delivery rates, wet or dry deposits, wide or narrow spray patterns. Due both to the diversity of compositions and product requirements, the size of the various orifices may vary over a wide range.

In a preferred embodiment of this type of valve, where particulate solids are either absent or present in too small a size or concentration to constitute a potential clogging problem, the valve stem orifice has a diameter within the range from about 0.3 to about 0.65 mm, at least one liquid tap orifice having a cross-sectional open area within the range from about 0.1 to about 0.8 $mm^2$, and at least one vapor tap orifice having a cross-sectional open area within the range from about 0.1 to about 0.8 $mm^2$, the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant gas:liquid aerosol composition within the range from about 8:1 to about 40:1, limiting the delivery rate of liquid aerosol composition from the container where the valve is open.

In a preferred embodiment of this type of valve, where particulate solids are present with a particle size and concentration that could clog small orifices, the valve stem orifice has a diameter within the range from about 0.5 to about 0.65 mm, at least one liquid tap orifice having a cross-sectional open area within the range from about 0.4 to about 0.8 $mm^2$, and at least one vapor tap orifice having a cross-sectional open area within the range from about 0.3 to about 0.8 $mm^2$, the ratio of liquid tap orifice to vapor tap orifice cross-sectional open area being within the range from about 0.5 to about 2.3; the open areas of the liquid tap orifice and vapor tap orifice being selected within the stated ranges to provide a volume ratio of propellant gas:liquid aerosol composition within the range from about 8:1 to about 40:1, limiting the delivery rate of liquid aerosol composition from the container when the valve is open.

In the special case where the liquid tap orifice is a capillary dip tube, and particulate solids are not present in size or amount to clog small orifices, the cross-sectional open area thereof is within the range from about 0.1 to about 1.8 $mm^2$, for flow of liquid aerosol composition into the blending space, and at least one vapor tap orifice through the wall has a cross-sectional open area within the range from about 0.1 to about 0.8 $mm^2$ for flow of propellant gas into the blending space; and the ratio of capillary dip tube to vapor tap orifice cross-sectional open area is within the range from about 1.0 to about 3.2.

In the special case where the liquid tap orifice is a capillary dip tube, where the solids are present in size or amount to clog small orifices, the cross-sectional open area thereof is within the range from about 0.6 to about 1.8 $mm^2$, for flow of liquid aerosol composition into the blending space, and at least one vapor tap orifice through the wall has a cross-sectional open area within the range from about 0.3 to about 0.8 $mm^2$ for flow of propellant gas into the blending space; and the ratio of capillary dip tube to vapor tap orifice cross-sectional open area is within the range from about 1.0 to about 3.2.

The controlling orifices to achieve the desired proportion of gas and liquid in the blend dispensed from the container are the vapor tap orifice, the liquid tap orifice (or in the case of a capillary dip tube, the capillary dip tube), and the valve stem orifice. The open areas of these orifices and the ratio of liquid tap orifice to vapor tap orifice open area should be controlled within the stated ranges. However, these dimensions are in no way critical to the operation of the shut-off valve, which can be used advantageously with delivery valves having other dimensions.

The valve delivery system normally includes, in addition to the valve stem orifice, an actuator orifice at the end of the passage through the actuator of the valve. The valve delivery system from the valve chamber through the valve stem and actuator to the delivery port thus includes, in flow sequence towards the delivery end, the valve stem orifice, the valve stem passage, and the actuator orifice. The controlling orifice in this sequence is the valve stem orifice, and the actuator orifice will normally have a diameter the same as or greater than the valve stem orifice, but not necessarily.

In the unlikely event that the actuator orifice has an open area that is less than the valve stem orifice, then the actuator orifice becomes the controlling orifice, downstream of the blending space, and its diameter may in that event be within the range from about 0.3 to about 0.65 mm when solids are not present, and from about 0.4 to about 0.65 mm when solids are present.

The orifice ranges given are applicable to dispersion-type antiperspirant aerosol compositions. Other orifice ranges may be used with other types of aerosol compositions.

The invention is also applicable to aerosol containers which have at least two compartments, a first aerosol composition compartment and a second liquefied propellant gas compartment, the propellant compartment and the valve and chamber being communicated by at least on vapor tap orifice, which is across the line of flow through the blending space to the valve delivery port from the propellant compartment. A liquid aerosol composition to be expelled from the container is placed in the first compartment of the container, which is in flow communication via a liquid tap orifice with the valve chamber, so as to admit liquid aerosol composition into the blending space across the line of propellant gas flow via the gas orifice or orifices to the delivery valve. When the delivery valve is opened, the propellant passes in gaseous form through the gas tap orifice(s) and propels the liquid aerosol composition to and through the open delivery valve passage out from the container.

The overall dimensions of the vapor tap and the liquid tap orifice(s) are selected according to the required product delivery rate (including propellant expelled).

In a preferred embodiment, the delivery valve is a slide valve movable into the open position against the biasing force of the bias means by manual manipulation of the valve actuator. The valve has a reciprocable poppet attached to the valve stem, movable between an open position in which both the blending space and the valve stem passage are linked in fluid flow communication via a valve stem orifice, and a closed position in which the valve stem orifice is not in registration with the blending space and the valve stem passage; and bias means holding the valve in the closed position.

The valve poppet has a fluid flow passage therethrough, in flow communication when the valve is open with the blending space and the valve stem passage. The passage can include the valve stem orifice, and can also include the shut off valve, described in detail below.

Because the blending space has a volume of less than 0.2 cc (less than 0.1 cc with the delivery valve open) the valve accordingly prevents expulsion of more than a minor amount of liquefied propellant when the container is shaken. Although when the container is shaken the blending space can fill with liquefied propellant, a volume of less than about 0.1 cc of liquefied propellant is too small to pose a flame hazard when the delivery valve is opened, for delivery of aerosol composition from the container.

In order to prevent delivery of flammable liquefied or gaseous propellant when the container is in an inclined or inverted position, the vapor tap valve of the invention includes a shut-off valve of the type described in Ser. No. 754,471, disposed in the flow passage or in a recess in the delivery valve poppet, and movable across the line of flow of fluid through the valve stem orifice and the valve stem passage to the delivery port, to shut off such flow.

Thus, the shut-off valve can shut off flow at the valve stem orifice, or in the valve stem passage leading directly to the delivery port, downstream of the delivery valve.

It is sufficient to close off the valve stem orifice or passage, since this will prevent escape of all fluid from the container. In all such cases, all fluid flow is cut off, even if the manipulatable delivery valve be open.

The shut-off valve in accordance with the invention can take any of several forms.

A preferred embodiment of shut-off valve has a valve means which is free to roll within a passage or recess in the delivery valve poppet with gravity, such as a cylinder or ball, which can roll freely along a wall of the passage or recess when inclined into a position at a shut-off valve seat closing off the valve stem orifice or passage when the valve or container is in any position between a few degrees less than horizontal to fully inverted, i.e., from $-2°$ to $-90°$ below the horizontal, but which normally is drawn by gravity into an at-rest position in which the shut-off valve is open when the top of the valve or container is in any position between a few degrees below the horizontal to fully upright, i.e, $+90°$. As the valve or container is brought from an upright position toward the horizontal, the ball or cylinder can roll down towards the shut-off valve seat, and at some angle near the horizontal will roll into position on the shut-off valve seat, closing off flow to the valve stem passage.

A particularly useful form of shut-off valve includes an orifice communicating the passage or recess in the poppet with either the atmosphere outside the aerosol container in which the valve is fitted, and/or the blending space outside the valve poppet within the container. The recess or passage of the poppet thus is in flow communication through the orifice with the atmosphere when the delivery valve is in the closed position, but the orifice is closed off when the poppet is in the open position. When the container is inverted, and the delivery valve is open, the shut-off valve moves to the valve seat and is held against the valve seat by the propellant gas pressure in the container, closing off all fluid flow to the delivery port. When the delivery valve is closed and the container is turned to the upright position, the orifice since it is open to atmospheric pressure makes it possible to balance the pressure on each side of the shut-off valve and the weight of the valve causes the valve to move away from the valve seat.

Accordingly, the valve of the invention, incorporating as it does both delivery valve and shut-off valve in one valve, as well as a very small blending space, eliminates any flammability hazard arising from delivery of liquefied flammable propellant at the delivery port when the container is in any position, from upright to inverted and any position in between.

Another embodiment of the shut-off valve of the invention is a slide valve, slidable along a guide such as the inside wall of the poppet passage or recess, between open and closed positions. In the open position, the slide valve is away from the shut-off valve seat and the valve passage is open. As the container is brought into a fully inverted position at an angle at about 10° or so beyond the horizontal, the slide valve slides along the guide into contact with the shut-off valve seat, closing off the valve stem orifice or passage.

The slide valve can also for example be tubular or annular, and arranged to slide along a concentric tubular guide, the guide constituting a shaft within the passage or recess of the poppet. The side of the tubular slide valve can be arranged to close off the valve stem orifice.

Another form of slide valve has a disc with a flanged outer periphery, movable along the concentric tubular guide within the passage or recess. The valve stem orifice to be closed off is axially disposed, in a wall of the valve stem. The valve stem orifice is accordingly closed off when the disc comes into abutment with and covers over the orifice, guided in this position by the tubular guide.

Inasmuch as the shut-off valve moves in a passage or recess in the delivery valve poppet, and this passage or recess is downstream of the valve stem orifice, the passage or recess can serve also as a further blending space for further mixing of the gas and liquid, supplementing the preceding blending space of limited volume. To further enhance the mixing function of this space, an additional orifice can be placed at or adjacent the shut-off valve seat, leading into the valve stem passage beyond. This additional mixing function is not essential, but is useful under some circumstances, and ensures that all available blending space is well utilized.

In the case where particulate solids are not present, or present only in an insufficient amount to cause clogging, the additional orifice has a diameter within the range of 0.3 mm to the inside diameter of the valve stem passage. In the case where particulate solids are present, the additional orifice has a diameter within the range of 0.5 mm to the inside diameter of the valve stem passage.

The additional mixing stage helps to produce aerosol droplets of more uniform size, and permits better control of droplet size. Droplet size is controlled by varying the size of the valve stem orifice and the additional orifice diameters. The smaller the diameters of these orifices, the smaller the size of the aerosol droplets, other conditions being equal. Where the aerosol spray constitutes an inhalation hazard, as in the case of an aerosol insecticide, relatively large droplets are preferred. In that event, the second orifice is either large, or is omitted.

Other variations will be apparent to those skilled in this art.

Preferred embodiments of aerosol containers in accordance with the invention are illustrated in the drawings, in which:

FIG. 1 represents a fragmentary sectional view of an aerosol container having therein one embodiment of vapor tap valve in accordance with the invention, including a vapor tap orifice, a liquid tap orifice in the form of a capillary dip tube in fluid flow connection, a valve stem orifice, a bleed orifice, and with the shut-off valve of the invention arranged as a free-rolling ball valve in a central recess of the valve poppet of the delivery valve, and movable into a position on a valve seat at the inlet end of the valve stem passage, closing off the valve stem passage, and showing both the delivery valve and the ball valve in the open positions;

FIG. 2 represents a cross-sectional view taken along the line 2—2 of FIG. 1;

FIG. 3 represents a fragmentary longitudinal sectional view of another embodiment of vapor tap valve in accordance with the invention, with a shut-off valve similar to that of FIG. 1, but with the bleed and valve stem orifices combined as one orifice;

FIG. 3A is a detailed view of the vapor tap valve of FIG. 3 in an open position;

FIG. 4 represents a cross-sectional view taken along the line 4—4 of FIG. 3;

FIG. 5 represents a fragmentary longitudinal sectional view of another embodiment of vapor tap valve, in which the shut-off valve is a slide valve; and FIG. 6 represents a cross-sectional view taken along the line 6—6 of FIG. 5.

Figure 1A:
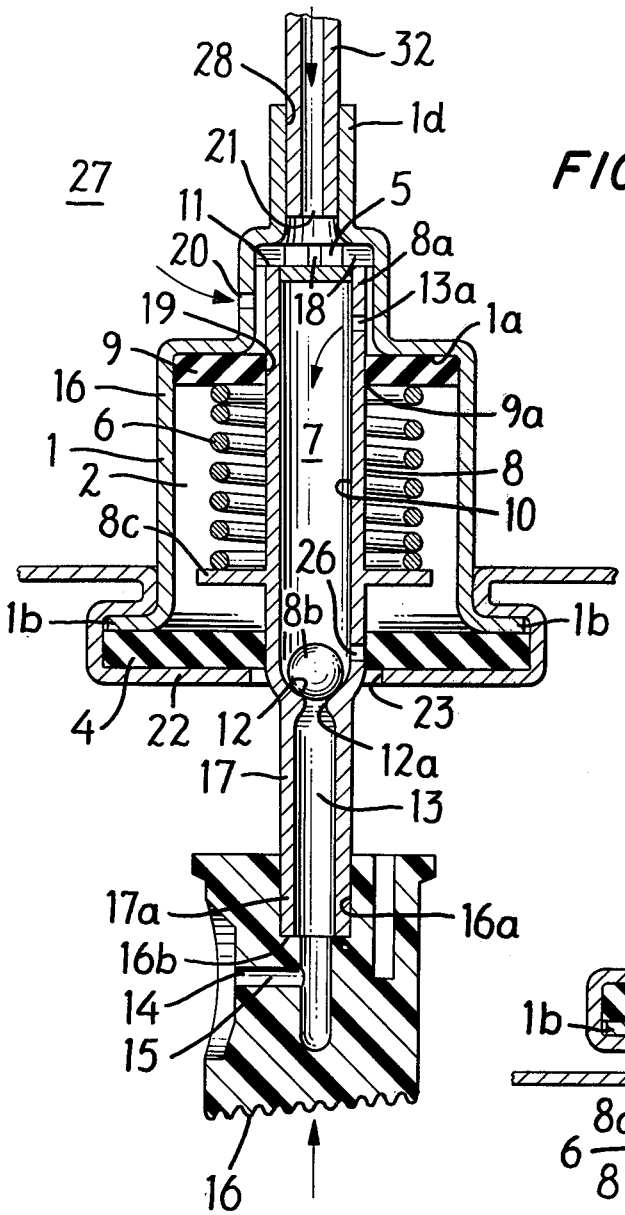
FIG. 1A represents a detailed view of the vapor tap valve of FIG. 1, but inverted, showing the delivery valve in the open position and the shut-off valve in the closed position.

In principle, the preferred aerosol containers of the invention utilize a container having at least one compartment for propellant gas and liquid aerosol composition, communicated by at least one gas tap orifice and at least one liquid tap orifice to a blending space of a vapor tap valve which is across the line of flow and communicates the blending space via a valve stem orifice and a valve stem passage to the valve delivery port. A liquid aerosol composition to be blended with propellant gas and then expelled from the container is placed in this compartment of the container, in flow communication via the liquid tap orifice with the blending space, so as to admit liquid aerosol composition into the blending space, while propellant gas flows into the blending space via the gas tap orifice or orifices to the valve. The mixture when the valve is open then flows through the valve stem orifice and passage to the delivery port.

The aerosol containers in accordance with the invention can be made of metal or plastic, the latter being preferred for corrosion resistance. However, plastic-coated metal containers can also be used, to reduce corrosion. Aluminum, anodized aluminum, coated aluminum, zinc-plated and cadmium-plated steel, tin, and acetal polymers such as celcon or delrin are suitable container materials.

The aerosol container 1 shown in FIGS. 1, 1A, 1B and 2 has a vapor tap valve of the invention comprising a valve housing 1 open at each end, with a valve chamber 2 closed off to entry of fluid via gaskets 4, 9. Within the valve chamber is a compression spring 6 and a hollow valve poppet 8 combining in one member a delivery valve poppet 8*a* and a shut-off ball valve 8*b*. The delivery valve poppet 8*a* seats against the sealing face 19 of the sealing gasket 9. The shut-off ball valve 8*b* rolls through the recess 7 of the poppet along the inside wall 10 of the poppet 8*a*, between an open position at the tip end 11 of the poppet and a closed position against the valve seat 12 at the inlet end of the valve stem passage 13, closing off the orifice 12*a* at the valve seat. The valve stem passage 13 beyond orifice 12*a* leads to a delivery port 14 via a passage 15 in a valve button actuator 16, which is pushed in by the finger against the biasing force of spring 6 to open the delivery valve.

Extending through a side wall of the poppet 8*a* and in flow communication with recess 7 is a valve stem orifice 13*a*. The gasket 9 has a central opening 9*a* therethrough, which receives the valve poppet 8*a* in a sliding leak-tight fit, permitting the poppet to move easily in either direction through the opening without leakage of propellant gas or liquid from the container.

Figure 1B:
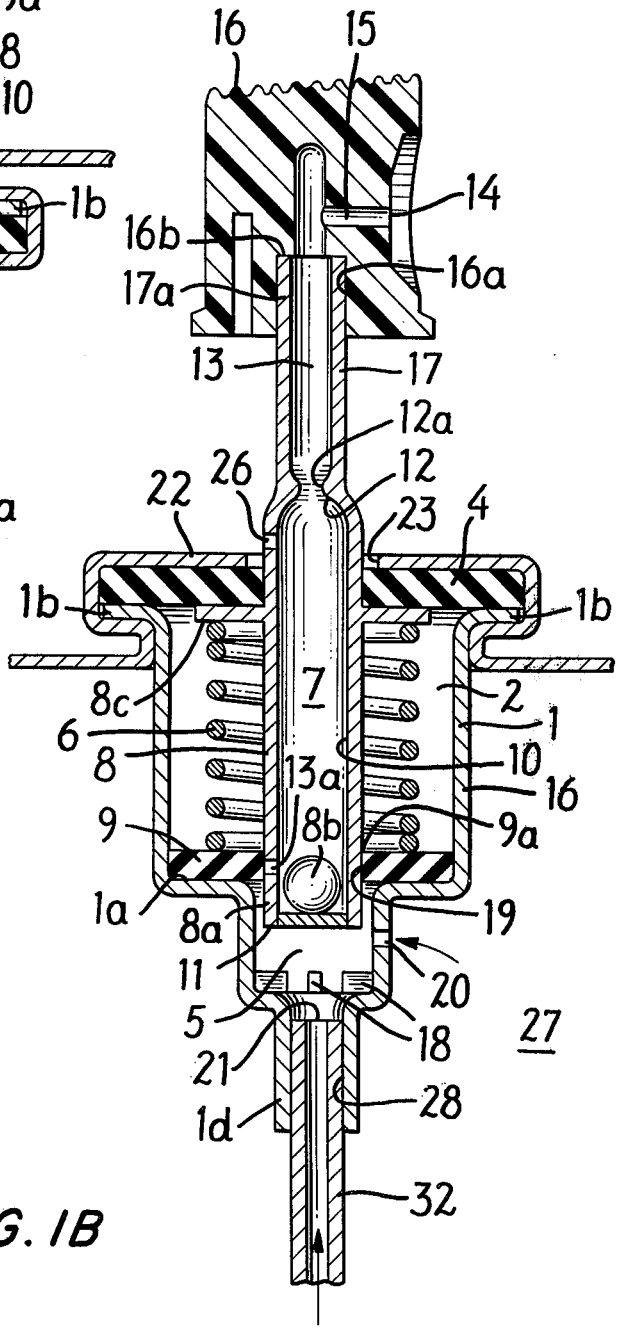
FIG. 1B represents a detailed view of the vapor tap valve of FIG. 1, showing the delivery valve in the closed position, and the shut-off valve in the open position.

When the vapor tap valve is in the outwardly extended position shown in FIG. 1B, the surface of the poppet portion 8*a* contiguous with valve stem orifice 13*a* is in sealing engagement with the sealing face 19 of the gasket 9, closing off the valve stem orifice 13*a* and the passage 13 to outward flow of the contents of the blending space 5. When the valve is in the inwardly pushed position shown in FIGS. 1 and 1A, the valve stem orifice 13*a* is within the blending space 5, and puts blending space 5 in fluid communication with the delivery port via the recess 7 of poppet 8*a*, valve stem passage 13, and button actuator passage 15. Since the blending space 5 receives both gas and liquid, passing through the gas and liquid tap orifices 20 and 21 in the housing 1, the valve 8*a* controls all outward flow of all of the contents of the container. The projections 18 serve to limit the inward stroke of the poppet into the space 5.

The outer end portion 17*a* of the valve stem 17 is received in the axial socket 16*a* of the button actuator 16, the tip engaging the ledge 16*b* of the socket. The stem is attached to the actuator by a press fit. The axial socket 16*a* is in flow communication with the lateral passage 15, leading to the actuator (valve delivery) orifice 14 of the button 16.

The compression coil spring 6 has one end retained on the flange 8*c* of the valve poppet 8*a*, and is based at its other end upon inner wall 1*a* of the valve housing 1. The spring 6 biases the poppet 8*a* outwardly, so that the valve stem orifice 13*a* is held in a leak-tight seal at the valve seat 19, and the passage 13 of the valve stem is closed off.

The delivery valve is however reciprocably movable away from the valve seat 19 by pressing inwardly on the button actuator 16, thus moving the valve stem 17 and with it poppet 8*a* against the spring 6. When the valve is moved far enough away from the seat 19, into the position shown in detail in FIGS. 1 and 1A, the orifice 13*a* is brought beneath the valve gasket 9, and a flow passage is therefore open from the blending space 5 defined by the valve housing 1 to the delivery port 14.

The limiting open position of the valve poppet 8*a* is fixed by the stops 18.

The valve housing 1 has an expanded portion 1*b* upon which is held the sealing gasket 4, retained in position at the upper end of the housing by the mounting cup 22, with the valve stem 17 extending through an aperture 23 in the cup. The cup 22 is attached to the container dome 24, which in turn is attached to the main container portion 25.

A bleed orifice 26 is provided through the poppet 8, outside the aerosol container, for venting of the recess 7 of the poppet 8*a* when the ball valve 8*b* is at the valve seat 12 (see FIG. 1B). When the delivery valve is open, however, the bleed orifice 26 is sealed off by gasket 4, as shown in FIGS. 1 and 1A.

Through the side wall 16 of the valve housing 1 is a vapor tap orifice 20 which is in flow connection with the blending space 5 within the valve housing 1 and the space 27, and therefore with the gas phase of propellant which rises into this portion of the container. Below the vapor tap orifice 20 the valve housing 1 terminates in a passage 28 enclosed in the projection 1*d* of the valve housing 1. In the passage 28 is inserted on end of the capillary dip tube 32, which extends all the way to the bottom of the container, and thus dips into the liquid phase of the aerosol composition in portion 29 of the container. Liquid aerosol composition accordingly enters the blending space 5 at passage 28 via the liquid tap orifice 21 and capillary dip tube 32, so that the dip tube serves as a long liquid tap orifice, while gas enters the blending space 5 through the gas tap orifice 20.

In the valve shown, the diameter of the actuator (valve delivery) orifice 14 is 0.5 mm. The diameter of the valve stem orifice 13*a* and the valve seat orifice 12*a* are 0.5 mm. The diameter of the vapor tap orifice 20 is 0.89 mm, and the inside diameter of the capillary dip tube 32 is 1.0 mm. The diameter of the bleed orifice 26 is 0.33 mm. The ball valve 8*b* is 0.25 cm in diameter, and the recess 7 has a diameter of 0.3 cm. The valve stem passage 13 has a diameter of 0.20 cm. Wall and gasket thicknesses are 0.1 cm. The blending space 5 has an inside diameter of 0.55 cm and a height of 0.2 cm, giving a volume of 0.04 to 0.05 cc. The projections 18 are 0.05 cm high. When the delivery valve is in the open position, the volume of the blending space is reduced to about 0.01 cc, between the projections 18.

In operation, button 16 is depressed so that the valve stem 17 and with it valve poppet 8*a* and valve stem orifice 13*a* are manipulated to the open position, away from the valve seat 19, and bleed orifice 26 is closed by gasket 4. Liquid aerosol composition is thereupon drawn up via the capillary dip tube 32 and the liquid tap orifice 21 into the space 5, where it is mixed with propellant gas via orifice 20 and then flows through the valve stem orifice 13*a* and recess 7, valve seat orifice 12*a*, the valve stem passage 13, and the actuator passage 15, to and through the delivery orifice 14. The dimensions of the orifices 20, 21, 32, 13*a*, 12*a* are such that at least about 8 volumes of gas enter through the vapor tap orifice 20 for each volume of liquid entering through the liquid tap orifice 21 from the capillary dip tube 32.

The ball shut-off valve 8b is arranged to close off the valve stem passage 13 at orifice 12a when the container is inverted, or inclined below the horizontal. The ball valve 8b is of stainless steel, and is free to roll in recess 7. When the ball is against the valve seat 12, it closes off the orifice 12a and valve stem passage 13. In the open position, the ball valve 8b is in the lowermost position, and rests against the tip end 11 of recess 7, as shown in FIG. 1. In this position, the container is upright, and the valve 8b under the force of gravity remains in this position.

It will be apparent, however, that when the container is inverted, the ball 8b will roll along the wall 10 of poppet 8a into the newly lowermost position (corresponding to the closed position) shown in FIG. 1A, with the ball valve 8b closing off the orifice 12a and valve stem passage 13. This effectively prevents liquid from escaping from the container. Accordingly, a flammability hazard due to the escape of flammable liquid is avoided.

This container is capable of delivering a dispersion type aerosol antiperspirant composition of conventional formulation at a delivery rate of about 0.4 g/second, about 40% of the normal delivery rate of 1 g/second. Accordingly, in order to obtain the same delivery of active ingredients (such as active antiperspirant) per squirt of a unit time, it is necessary to considerably increase the concentration of active antiperspirant composition. Normally, such compositions contain less than 5% active antiperspirant, because of clogging problems using standardized aerosol container valve systems and dimensions. In this container, however, it is possible to deliver at a low delivery rate about 0.3 to about 0.7 g/second of aerosol antiperspirant composition containing from about 8% to about 20% active ingredient as suspended or dispersed solid material without clogging, because of the high proportion of gas to liquid.

The vapor tap valve shown in FIGS. 3 and 4 is generally similar to that of FIGS. 1, 1A, 1B, and 2, and consequently like reference numerals are used for like parts. In this embodiment, the shut-off ball valve 45 of the invention rolls within the recess 46 of the hollow valve poppet 40, towards and away from a valve seat 41 and valve seat orifice 41a across the valve stem passage just downstream of the valve stem orifice 43a, on the other side of recess 46. Consequently, all fluid flow from the container is shut off when the shut-off valve 45 is in the closed position on the valve seat 41, as shown in dashed lines in FIGS. 4 and 4.

In this embodiment, the vapor tap valve has a valve stem 17 having a valve button 16 attachment at one end, with valve button passage 15 and delivery orifice 14 therethrough, and a valve housing 44. The valve housing 44 has a blending space 5a with vapor tap orifice 42 and liquid tap orifice 49 communicating the blending space with the storage compartment of the container. The delivery valve portion of the valve stem 17 is in the form of a hollow valve poppet 40. The valve stem orifice 43a is open to the atmosphere and functions as a bleed orifice for the space 46 within the poppet when the poppet 40 is in the closed position, seen in FIG. 3. The valve poppet 40 is reciprocably mounted on the valve stem 43. The shut-off ball valve 45 is free to roll in recess 46. Poppet 40 is biased by the spring 48 into the normally closed position where it seals against valve seat 19 on the inside face of the gasket 9. When the valve poppet 45 is below this seat, the valve stem orifice 43a is in flow communication via the blending space 5a with the liquid tap orifice 49 and the vapor tap orifice 42.

The valve housing 44d in the portion below the blending space 5a is provided with a passage 28 which is shaped to receive the end of the capillary dip tube 32a.

The liquid aerosol composition is stored in the lower portion 29a of the container, and the dip tube 32a extends from the lower portion 29a of the container into the passage 28a of the valve housing 44, in which it is press-fitted in place. The dip tube puts the liquid phase in the bottom of the container in flow connection with the blending space 5a.

The shut-off valve is a stainless steel ball 45 which is free to roll in the recess 46 of the poppet 40. When the valve is upright, or inclined but above the horizontal, the ball valve 45 is in the bottom of chamber 46; there, it is out of the line of flow from the valve stem orifice 43a to orifice 41a and valve stem passage 43 via the recess 46. With the valve inverted or below the horizontal, the ball valve 45 rolls to the other end of the recess 46 and covers over the orifice 41a at the inner end of the valve stem passage 43, effectively closing off the passage to delivery of any of the contents of the container. Accordingly, a flame hazard when the container is inverted due to the escape of flammable liquid is avoided.

In this embodiment, the capillary dip tube 32a inside diameter is 0.76 mm, the vapor tap orifice 42 diameter is 0.64 mm, and the valve stem orifice 43a diameter is 0.5 mm and the valve seat orifice 41a diameter is 0.4 mm. The stroke of the valve poppet is 0.2 cm, the compression spring is 0.2 cm, and the blending space 5a height is 0.4 cm, so that the space has a volume of about 0.09 cc, and half this volume when the delivery valve is in the open position. The diameter of the actuator (valve delivery) orifice 14 is 0.5 mm. The ball valve 45 is 0.25 cm in diameter and the recess 46 is 0.3 cm in diameter. The valve stem passage 43 diameter is 0.2 cm.

The vapor tap valve shown in FIGS. 5 and 6 is generally similar to that shown in FIGS. 1, 1A, 1B and 2 and consequently like reference numerals are used for like parts. In this embodiment the shut-off valve 50 is a slide valve which slides within the recess 51 of the hollow valve poppet 52 toward and away from a valve seat 53 and valve seat orifice 54 across the valve stem passage 55 just downstream of the valve stem orifice 55a.

The slide valve 50 is in the form of a ring with a central aperture 56. The outer periphery of the ring is tapered to facilitate release of the ring from sealing relationship with the valve seat 53 which is correspondingly tapered to seal with the side of the valve. When in sealing relationship with the valve seat, the valve 50 closes off the valve stem passage 55 by sealing at seat 53 across the valve stem orifice 55a. Consequently, all fluid flow from the blending space 5 into the valve stem passage 55 through the valve stem orifice 55a is cut off when the valve is in this position.

It will be apparent that when the valve is held upright, in the position shown in FIGS. 5 and 6 the valve 56 is at the bottom of the recess 51 in the valve stem. When however the valve is inverted, the valve disc 56 moves to the other side of the recess 51, and comes into sealing relationship with the valve seat 53, closing off the valve stem passage 55 and valve stem orifice 55a. Consequently, all fluid flow from the container is shut off when the valve is inverted, averting a flame hazard, due to the escape of flammable liquid from the blending space 5.

The vapor tap valve of the invention can be used in any kind of aerosol container to deliver any aerosol composition in the form of a spray. The range of products that can be dispensed is diverse, and includes pharmaceuticals for spraying directly into oral, nasal and vaginal passages, antiperspirants, deodorants, hair sprays, fragrances and flavors, body oils, insecticides, window cleaners and other cleaners, spray starches and polishes for autos, furniture and shoes.

Having regard to the foregoing disclosure, the following is claimed as the inventive and patentable embodiments thereof:

1. A vapor tap valve for aerosol containers for use with aerosol compositions containing liquefied flammable propellants, inhibiting delivery of flammable liquid propellant when the valve is opened in any orientation of the aerosol container, comprising, in combination, a delivery valve movable manually between open and closed positions and including a valve poppet having a passage for fluid flow therethrough, a valve stem having a valve stem passage for fluid flow therethrough, and a delivery port; bias means biasing the delivery valve poppet towards a closed position; a blending space having an open volume not exceeding about 0.2 cc for mixing propellant and aerosol composition in fluid flow communication with the valve stem passage via the valve poppet passage, the valve poppet passage when the valve poppet is in the open position communicating the blending space with the valve stem passage, and the valve poppet in the closed position preventing such communication; a liquid tap orifice in the blending space; a gas tap orifice in the blending space; and a shut-off valve disposed in association with the valve poppet and responsive to orientation of the valve to move automatically between positions opening and closing off flow of propellant to the delivery port via the valve stem passage, the shut-off valve moving into an open position in an orientation of the valve between a horizontal and an upright position, and moving into a closed position in an orientation of the valve between the horizontal and an inverted position.

2. A vapor tap valve according to claim 1, in which the shut-off valve is disposed in the valve poppet passage and there is a valve seat at the valve stem passage against which the shut-off valve seats and closes off fluid flow therethrough.

3. A vapor tap valve according to claim 2, in which the shut-off valve is a free-rolling ball valve.

4. A vapor tap valve according to claim 3, in which there is a recess off the valve poppet passage in which the ball is stored when in the open position of the valve.

5. A vapor tap valve according to claim 2, in which the shut-off valve is a slide valve.

6. A vapor tap valve according to claim 5, in which there is a recess off the valve poppet passage in which the slide valve is stored when in the open position of the valve.

7. A vapor tap valve according to claim 5, in which the valve poppet has a valve stem orifice therethrough, communicating the valve stem passage and the blending space, and the slide closes off the valve stem orifice.

8. A vapor tap valve according to claim 1, comprising a valve housing defining the blending space and a separate fluid-free valve chamber in which the delivery valve is movably disposed for movement between open and closed positions.

9. A vapor tap valve according to claim 1, in which the blending space has a volume not exceeding 0.1 cc.

10. A vapor tap valve according to claim 1, in which the liquid tap orifice communicates the blending space with a capillary dip tube.

11. A vapor tap valve according to claim 1, comprising a tail piece valve housing and a dip tube, and a tail piece having a through passage in fluid flow connection with the dip tube, and the blending space.

12. A vapor tap valve according to claim 1, in which both the delivery valve and the shut-off valve are attached to and move with the valve stem between open and closed positions against the biasing force of the bias means.

13. A vapor tap valve according to claim 12, in which the shut-off valve is a free-rolling ball valve.

14. A vapor tap valve according to claim 1, in which the valve poppet includes a bleed flow passage therethrough which in the closed position of the valve poppet communicates the valve poppet passage with the atmosphere.

15. A vapor tap valve according to claim 14, in which the bleed flow passage also serves as the valve stem orifice in the open position of the valve poppet.

16. An aerosol container for use with aerosol compositions containing liquefied flammable propellants inhibiting delivery of flammable liquid propellant when the valve is opened immediately after shaking the container and contents, comprising, in combination, a pressurizable container having at least one storage compartment and a delivery port for an aerosol composition and a liquefied propellant, in which compartment propellant can assume an orientation according to orientation of the container between a horizontal and an upright position, and a horizontal and inverted position; a vapor tap valve movable manually between open and closed positions, and including a valve poppet, a valve stem, a valve stem passage, and a delivery port; bias means biasing the delivery valve towards a closed position; a blending space for mixing propellant and aerosol composition in fluid flow communication with the valve stem passage via the valve, the valve in the open position communicating the blending space with the valve stem passage, and in the closed position preventing such communication; a liquid tap orifice in the blending space; a gas tap orifice in the blending space; and a shut-off valve disposed in association with the valve poppet and responsive to orientation of the valve to move automatically between positions opening and closing off flow of propellant to the dilivery port via the valve stem passage, the shut-off valve moving into an open position in an orientation of the valve between a horizontal and an upright position, and moving into a closed position in an orientation of the valve between the horizontal and an inverted position; an aerosol-conveying passage including the blending space in flow connection at one end with the storage compartment and at the other end with the delivery port, the vapor tap valve being disposed across the aerosol-conveying passage in a manner to control flow therethrough, manipulation of the dilivery valve opening and closing the passage to flow of aerosol composition and propellant from the storage compartment to the delivery port.

17. An aerosol container according to claim 16, in which the shut-off valve is a ball valve.

18. An aerosol container according to claim 17, in which the shut-off valve comprises a valve seat at the inner end of the valve stem passage, and the ball is adapted to roll into engagement with the valve seat and close off the valve stem passage at an orientation of the container between the horizontal and an inverted position, and adapted to roll away from the valve seat and open the valve passage at an orientation of the container between the horizontal and an upright position.

19. An aerosol container according to claim 16, in which the shut-off valve is a slide valve.

20. An aerosol container according to claim 19, in which the shut-off valve comprises a valve seat at the inner end of the valve stem passage, and the slide is adapted to slide into engagement with the valve seat and close off the valve stem passage at an orientation of the container between the horizontal and an inverted position, and adapted to roll away from the valve seat and open the valve passage at an orientation of the container between the horizontal and an upright position.

21. An aerosol container according to claim 16, in which the vapor tap orifice includes a valve housing receiving one end of a dip tube.

22. An aerosol container for use with liquid aerosol compositions containing liquefied flammable propellants, inhibiting delivery of flammable liquid propellant when the valve is opened immediately after shaking the container and contents, comprising, in combination, a pressurizable container having a delivery valve movable between open and closed positions and including a valve poppet, a valve stem, a valve stem passage, and a delivery port; bias means biasing the delivery valve towards a closed position; a blending space for mixing propellant and aerosol composition in fluid flow communication with the valve stem passage via the valve, the valve in the open position communicating the blending space with the valve stem passage, and in the closed position preventing such communication; a liquid tap orifice in the blending space; a gas tap orifice in the blending space; and a shut-off valve disposed in association with the valve poppet and responsive to orientation of the valve to move automatically between positions opening and closing off flow of propellant to the delivery port via the valve stem passage, the shut-off valve moving into an open position in an orientation of the valve between a horizontal and an upright position, and moving into a closed position in an orientation of the valve between the horizontal and an inverted position; a valve stem orifice in the valve stem in flow connection at one end with a valve chamber and at the other end with an aerosol-conveying valve stem passage leading to the delivery port; the valve stem orifice having a diameter within the range from about 0.3 to about 0.65 mm; the liquid tap orifice having a cross-sectional open area within the range from about 0.1 to about 0.8 mm; the vapor tap orifice having a cross-sectional open area within the range from about 0.1 to about 0.8 mm; the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant gas:liquid aerosol composition within the range from about 8:1 to about 40:1, thereby limiting the delivery rate of liquid aerosol composition and propel any gas from the container when the delivery valve is opened.

23. An aerosol container according to claim 22, in which the liquid tap orifice is a capillary dip tube whose cross-sectional open area is within the range from about 0.1 to about 1.8 mm; the vapor tap orifice has a cross-sectional open area within the range from about 0.1 to about 0.8 mm; and the ratio of capillary dip tube to vapor tap orifice cross-sectional open area is within the range from about 1.0 to about 3.2.

* * * * *

UNITED STATES PATENT AND TRADEMARK OFFICE

CERTIFICATE OF CORRECTION

PATENT NO. : 4,117,958

DATED : October 3, 1978

INVENTOR(S) : Joseph George Spitzer et al

It is certified that error appears in the above-identified patent and that said Letters Patent are hereby corrected as shown below:

| | | |
|---|---|---|
| Column 3, line 14 | : | "poses" should be --posed--. |
| Column 7, line 55 | : | "on" should be --one--. |
| Column 12, line 32 | : | "on" should be --one--. |
| Column 13, line 51 | : | "Figs 4 and 4" should be --Figs 3 and 4--. |
| Column 16, line 53 | : | "dilivery" should be --delivery--. |
| Column 16, line 64 | : | "dilivery" should be --delivery--. |

Signed and Sealed this

*Ninth* Day of *October 1979*

[SEAL]

*Attest:*

RUTH C. MASON
*Attesting Officer*

LUTRELLE F. PARKER
*Acting Commissioner of Patents and Trademarks*